United States Patent [19]

Watkins

[11] Patent Number: 4,457,378

[45] Date of Patent: Jul. 3, 1984

[54] FLOWLINE PULL-IN APPARATUS AND METHOD

[75] Inventor: Bruce J. Watkins, Palos Verdes, Calif.

[73] Assignee: Hughes Tool Company, Houston, Tex.

[21] Appl. No.: 402,178

[22] Filed: Jul. 26, 1982

[51] Int. Cl.[3] ..... E21B 43/01

[52] U.S. Cl. ..... 166/347; 405/169; 166/341; 166/343

[58] Field of Search ..... 166/339, 341, 342, 343, 166/344, 347, 349, 359, 360, 368; 405/169, 188

[56] References Cited

U.S. PATENT DOCUMENTS

| | | | |
|---|---|---|---|
| 3,690,112 | 9/1972 | Pattison | 166/359 |
| 3,777,688 | 12/1973 | Melhose | 166/342 |
| 4,367,980 | 1/1983 | Ames | 405/169 |
| 4,371,291 | 2/1983 | Morrill | 166/343 |
| 4,417,830 | 11/1983 | Shotbolt | 405/169 |

*Primary Examiner*—William F. Pate, III
*Assistant Examiner*—Timothy David Hovis
*Attorney, Agent, or Firm*—Robert A. Felsman

[57] ABSTRACT

A flowline pull-in apparatus is operable from an overhead vessel and transports flowlines to a subsea wellhead. The apparatus includes a sled disposed on the sea floor and connected to the flowlines. A two-part pull-in frame, removably positioned within the sled, is connected to the overhead vessel. The overhead vessel removes the pull-in frame and lands the frame on a wellhead. The frame is connected to the sled by means of cables. After the frame has been landed upon the wellhead, winches on the frame are hydraulically activated from the vessel and reel in the cables, thereby drawing the sled into engagement with the lower portion of frame and positioning flowline mandrels, which project from the sled, adjacent the lower portion of the frame. The cables are thereafter cut and the upper portion of the frame is released and removed by the vessel from the lower portion. A wellhead production system is then landed on the lower portion to establish fluid communication between the flowline mandrels and the wellhead.

7 Claims, 9 Drawing Figures

FLOWLINE PULL-IN APPARATUS AND METHOD

Field of the Invention

The present invention relates to the deepwater transportation of flowlines to a subsea wellhead.

Background of the Invention

Many offshore production well systems involve wellheads positioned on the ocean floor at depths of water greater than the depth at which divers can safely and readily work. In such deepsea offshore wells, the bringing of flowline conduits to the wellhead presents difficult problems which are not always carried out by presently available wellhead working equipment in a satisfactory or efficient manner. Furthermore, the carrying of the flowlines to the wellhead is often only done by specially equipped flowline lay vessels, rather than by the drilling vessel.

Additionally, the carrying of flowlines to the wellhead is often accomplished in part by running wire lines back to the surface, which are thereafter used to pull the flowlines to the wellhead. In deepwater situations, it is not often practical to run such wire lines back to the surface to accomplish this task.

Accordingly, it is the principal object of this invention to quickly and efficiently transport flowlines to a deepwater wellhead.

It is a further object of this invention to allow flowlines to be transported to a subsea wellhead either by a drilling vessel or by a flowline lay vessel.

It is a further object of this invention to eliminate the running of wire lines from the sea floor to an overhead vessel to accomplish flowline pull-in.

Summary of the Invention

The present invention, in a broad aspect, provides a remote vehicle disposed on the sea floor in attachment with subsea flowlines and remotely operable from an overhead vessel. The vehicle pulls the flowlines to a subsea wellhead under control of the vessel.

More specifically, the present invention provides a flowline pull-in apparatus, operable from an overhead vessel, for remotely transporting flowlines to a subsea wellhead. The apparatus includes a sled or base disposed on the sea floor and connected to the flowlines and carrying a two-part removable pull-in frame or body. The pull-in frame is connectable to the overhead vessel, whereby the vessel may remove the frame and position it upon a subsea wellhead. Cables interconnect the lower portion of the frame to the sled. After the frame is positioned on the wellhead, winches on the upper frame portion are activated from and controlled by the vessel to reel in the cables, thereby drawing the sled into engagement with the frame. The upper portion of the frame is then disconnected from the lower portion and removed therefrom by the vessel. A wellhead production system or "Christmas tree" is thereafter landed on the lower frame portion to establish fluid communication between the flowlines and the wellhead.

In accordance with one feature of the invention, the sled includes a base having tapered edges to facilitate the drawing of the sled across the sea floor. The sled also includes buoyancy control members to offset the weight of the flowlines and the base. The flowlines are attached to conduits which pass through the base and terminate in flowline mandrels extending from the base.

Hydraulically actuated valves are mounted in the conduits and control the flow of fluid into the flowlines.

In accordance with another feature of the invention, the lower frame portion includes tapered mandrels which extend from the base to guide the frame into engagement with the wellhead. The cables are attached to these tapered mandrels, which engage the lower frame portion when the winches reel in the cables. Guide feet on the lower frame portion engage a guide base on the wellhead to insure proper alignment with the wellhead. Pulleys are also provided on the lower frame portion to route the cable to the winches in the upper portion of the frame.

In accordance with another feature of the invention, the lower portion of the frame is connected to the upper portion of the frame by hydraulically releasable pins. The lower portion of the frame also includes hydraulically activated cable cutters which cut the cables interconnecting the base and the frame to allow the upper frame portion to be removed from the lower frame portion after the sled has been drawn into engagement with the frame.

In accordance with another feature of the invention, a method of attaching flowlines to the wellhead includes placing the sled, attached to the flowlines, and carrying its two-part removable frame, on the sea floor. The frame is then connected to an overhead vessel and landed on the wellhead. The hydraulic winches are thereafter activated and controlled from the vessel to reel in the cables interconnecting the sled to the frame, thereby pulling the sled and the flowlines across the sea floor into engagement with the frame. Thereafter, the cables are cut with the cutters and the upper frame is released from the lower frame via the releasable pins. A Christmas tree is then landed upon the lower frame to establish fluid communication between the flowlines and the well.

Other objects, features, and advantages of the present invention will become apparent from a consideration of the following detailed description and from the accompanying drawings.

Detailed Description

Figure 1:
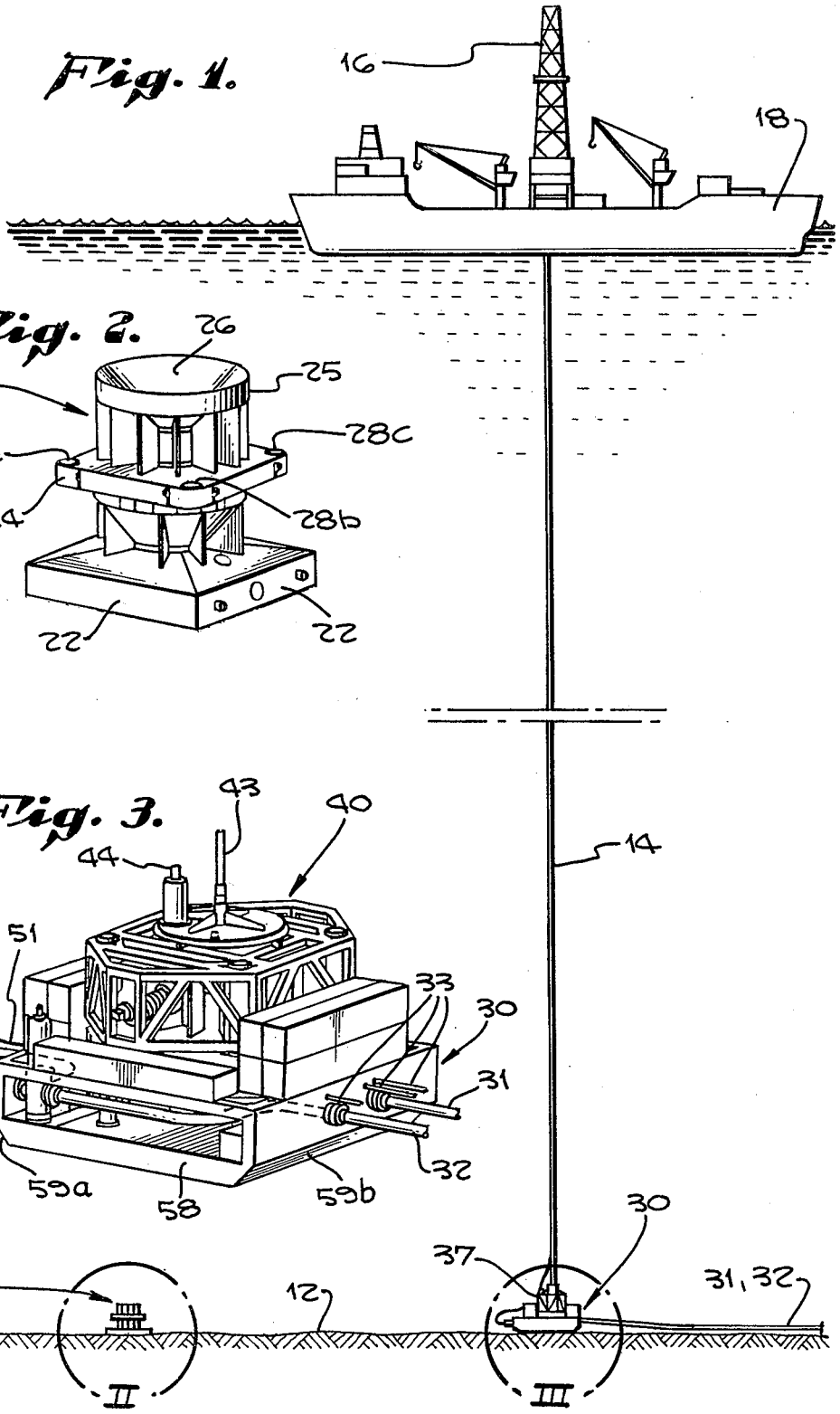
FIG. 1 shows a schematic view of the pull-in apparatus of the present invention resting on the sea floor, with the sled portion of the apparatus connected to flowlines and with the two-part frame portion of the apparatus connected to an overhead vessel.

Referring more particularly to the drawings, FIG. 1 shows an offshore production wellhead 20 connected to a subsea well not separately shown. In deepwater offshore production systems, the wellhead 20 may be greater than one-half mile below the ocean surface. The present invention is directed toward remotely transporting a pair of flowlines 31, 32 to the wellhead 20 without the need for intervention by a deepsea diver or the like. The transporting of the flowlines is remotely controlled by a floating vessel 18, which may either be drilling vessel having a rig 16 or a flowline lay vessel. A drilling vessel 18 has been shown in FIG. 1. The drilling vessel 18 is connected via a riser string 14 to the pull-in apparatus of the present invention. generally denoted 30.

Figure 3:
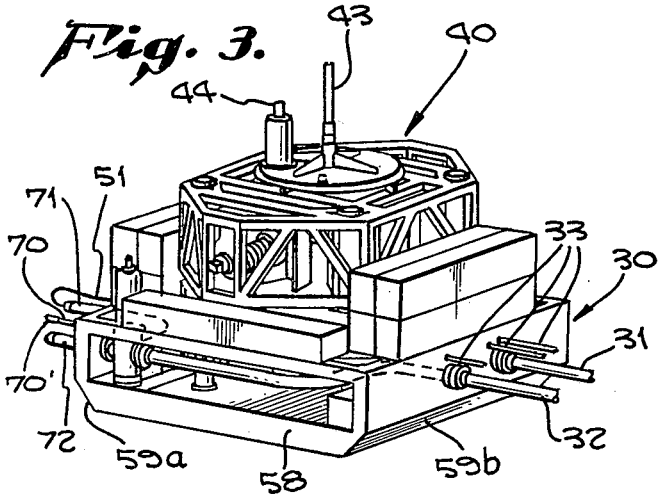
FIG. 3 shows a perspective view of the sled portion of the apparatus supporting the frame portion, prior to the frame portion being transferred to the wellhead.
Figure 5:
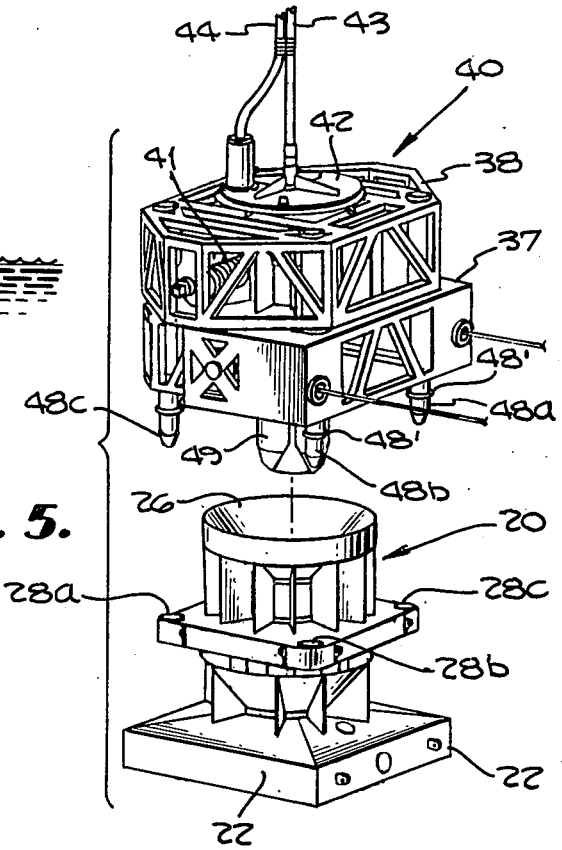
FIG. 5 shows a perspective view of the landing of the frame portion of the apparatus on the wellhead.
Figure 8:
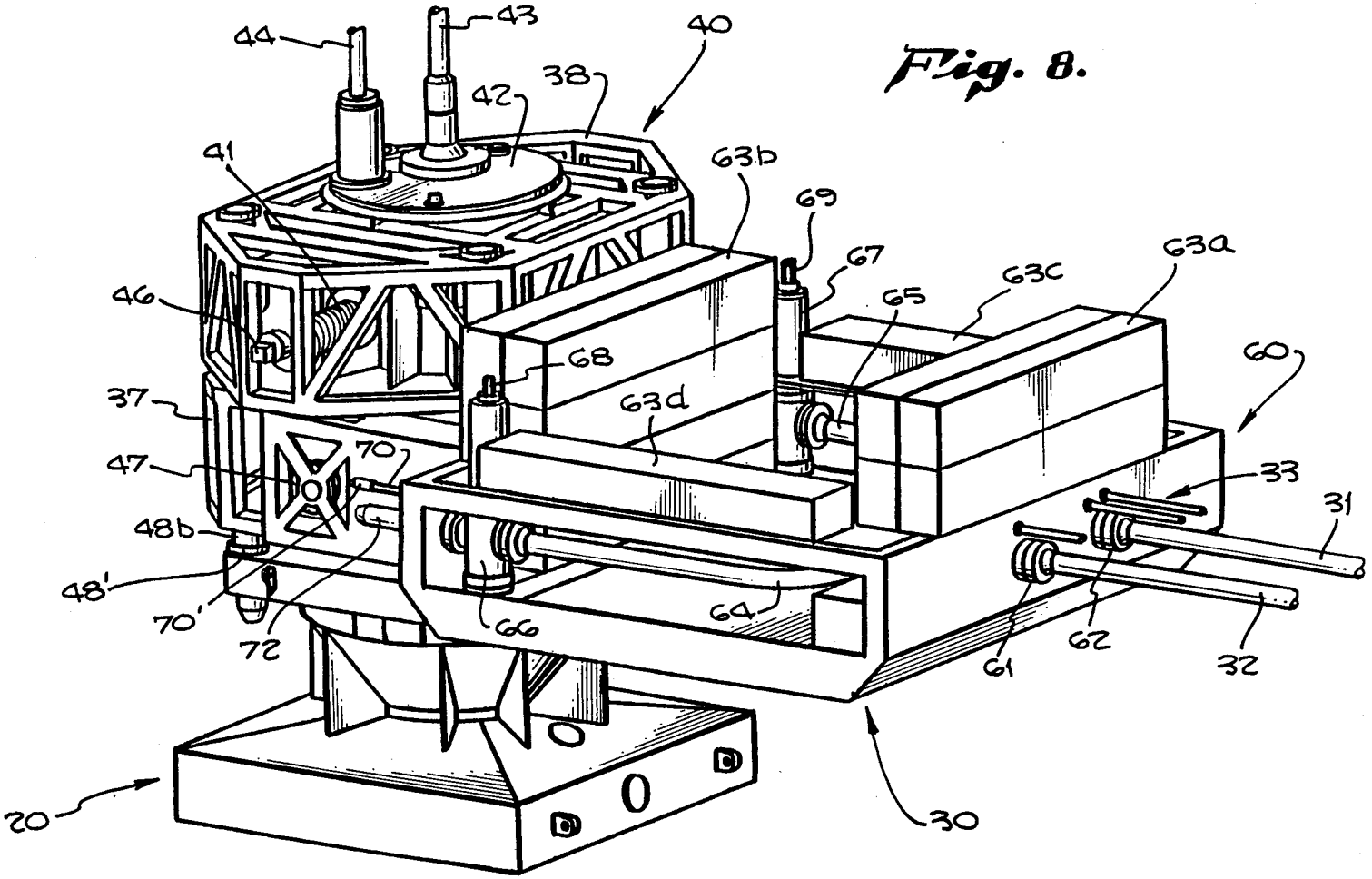
FIG. 8 shows a perspective view of the pull-in apparatus after the base portion has been reeled into engagement with the frame portion.

The pull-in apparatus 30 is shown in more detail in FIGS. 3, 5, and 8. The pull-in apparatus 30 is comprised of two primary parts, a base or sled portion 60 and a two-part pull-in frame or body portion 40, having an upper portion 38 and a lower portion 37. The sled 60 is connected to the flowlines 31 and 32 and is positioned on the sea floor 12 with the frame 40 resting therein, as shown schematically in FIG. 1. A pair of wire ropes or cables 50 and 51 interconnect the sled 60 and the frame 40.

Figure 2:
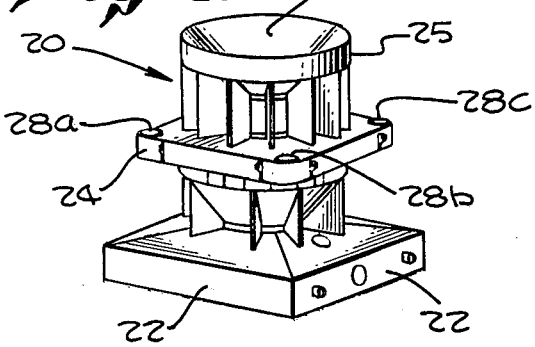
FIG. 2 shows a perspective view of a subsea wellhead to which the frame portion of the present apparatus is landed.

The wellhead 10 upon which the frame 40 is to be landed is shown in more detail in FIG. 2. The wellhead 20 comprises a mounting base 22 having a circular housing 25 supported thereon and carrying a guide base 24 having a plurality of mounting holes 28*a, b, c* which engage guide legs 48*a, b, c,* and accompanying flanges 48′ on the lower frame 37.

Figure 4:
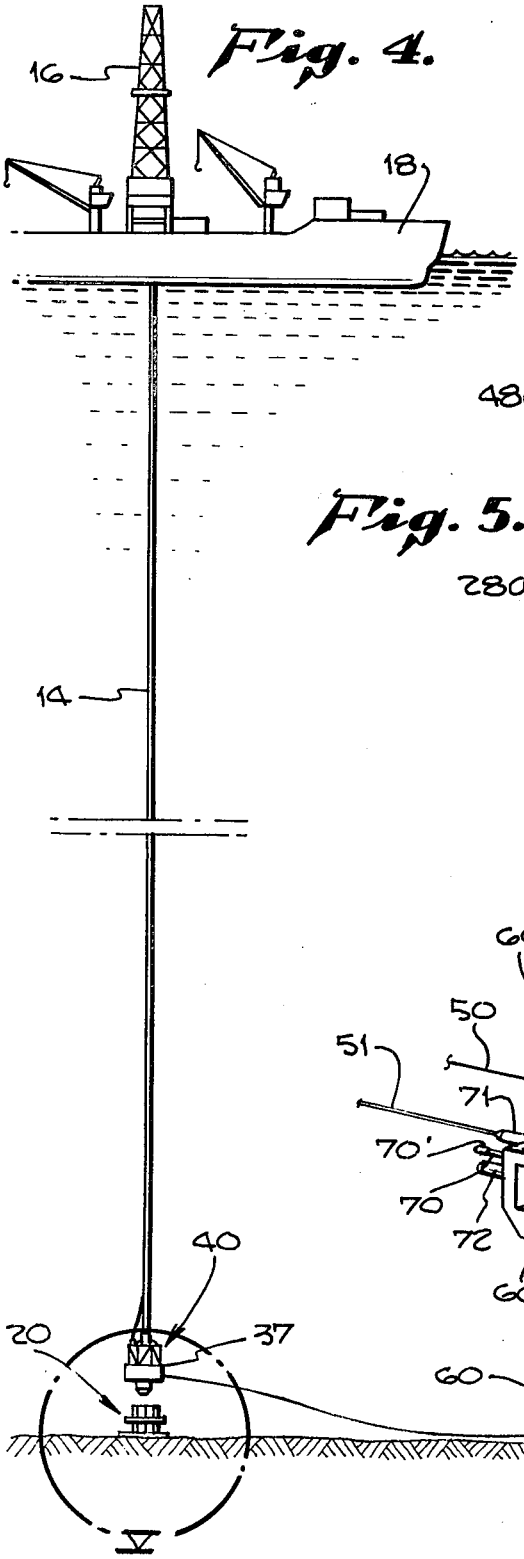
FIG. 4 shows a schematic view of the overhead vessel removing the frame portion of the apparatus from the base portion and landing the frame portion on the wellhead.
Figure 9:
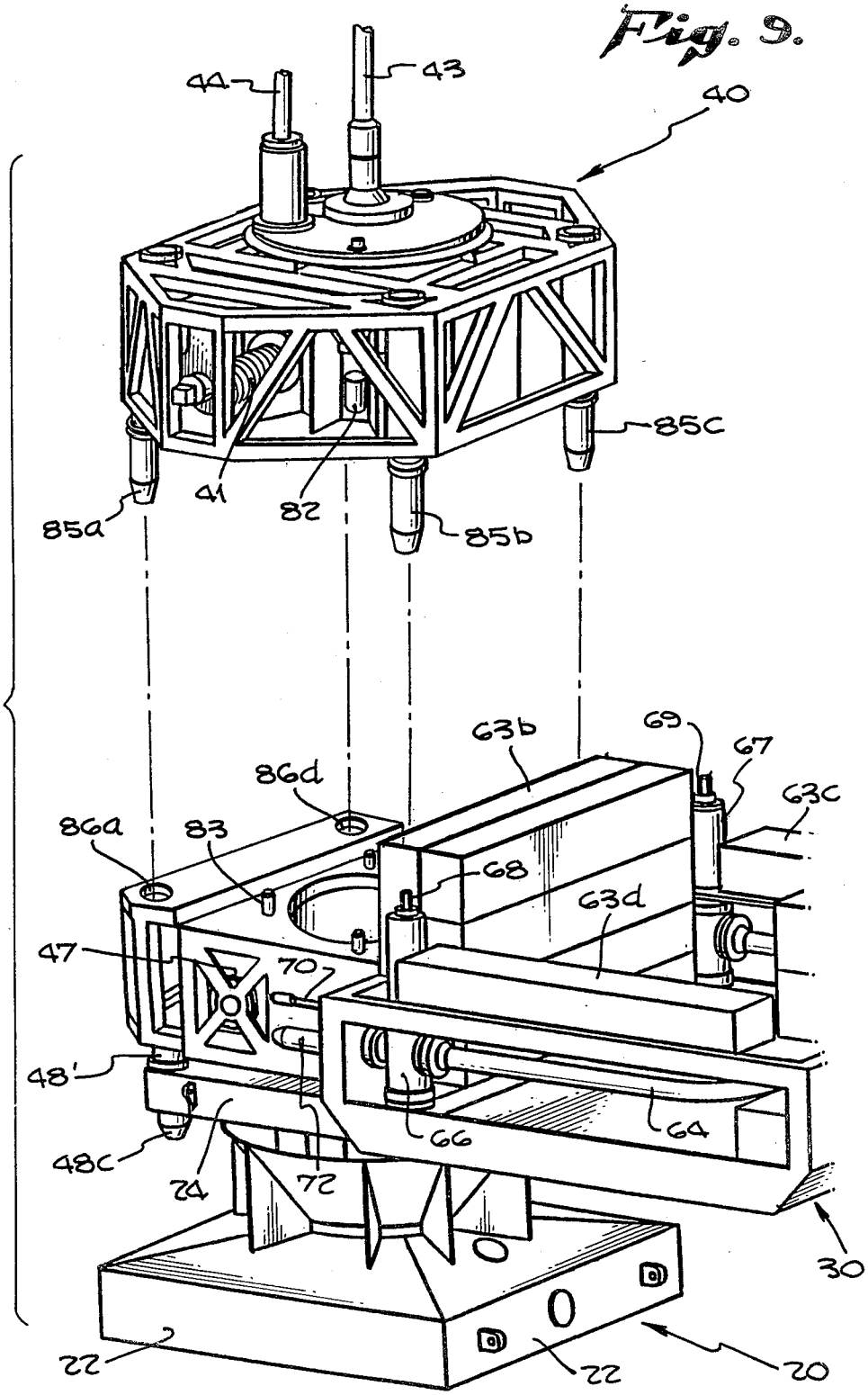
FIG. 9 shows a perspective view of the removal of the upper portion of the frame from the lower portion of the frame prior to the landing of a Christmas tree onto the lower frame portion to establish communication between the wellhead and the flowlines.

Briefly, the novel apparatus 30 of the present invention operates as follows. The frame 40 is connected by a completion/workover connector 42 to the riser string 14 from the overhead vessel 18. The frame 40 is lifted by the riser 14 out of the sled 60 and landed on the wellhead 20 by the vessel 18, as shown in FIG. 4. A portion of sled 60 between blocks 63*a,* 63*b,* 63*c* and 63*d* , serves as a seat for receiving frame 40. Thereafter, the cables 50 and 51 are reeled into the frame 40, thereby dragging the sled 60 into engagement with the frame, as shown in FIG. 8. A pair of flowline mandrels 72 and a pair of hydraulic control fluid mandrels 70 (only one of each which is shown) are then disposed adjacent the frame 40. The upper portion 38 of the frame 40 is then disconnected from the lower portion 37 of the frame 40, thereby leaving the lower portion 37 on the wellhead 20, as shown in FIG. 9. A conventional Christmas tree assembly (not shown in the figures) is landed on the lower frame portion 37 to establish fluid communication between the well and the flowlines 31 and 32.

Figure 6:
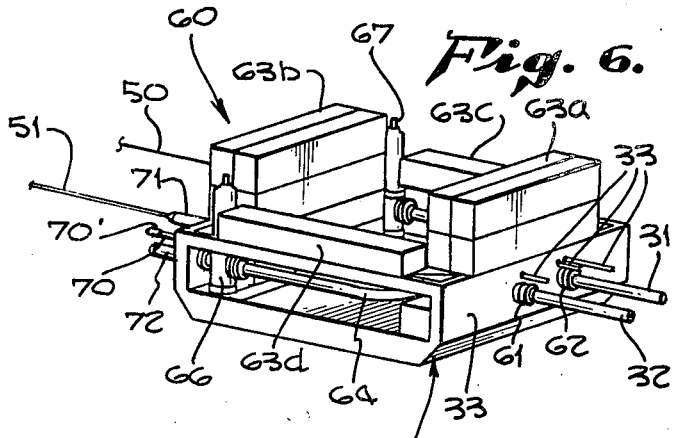
FIG. 6 shows the sled portion of the apparatus, connected to the flowlines, after the frame portion has been removed therefrom.

FIGS. 3, 6, and 8 show the sled 60 in more detail. As shown therein, the sled 60 includes a flowline base 58 having a pair of flattened edges 59*a* and 59*b* to facilitate the dragging of the sled 60 across the sea floor. The base 58 is provided with a pair of flowline connectors 61 and 62 by which connection is made to the flowlines 32 and 31, respectively. Internal conduits 64 and 65 pass from the connectors 61 and 62 through the sled to allow fluid communication across the sled. Each of these internal conduits 64 and 65 terminate in a flowline mandrel 72 projecting out of the base 58. A pair of tapered mandrels 71 (only one of which is shown) also project from the base 58 and are attached to the cables 50 and 51. These tapered mandrels are pulled into a pair of ports 52 and 53 on the lower frame portion 37 when the cables 50 and 51 are reeled into the lower frame portion 37. The tapered ends of the mandrels 71 assist in guiding the base 58 into proper alignment with the frame 40.

The flowline sled 60 is also provided with a plurality of blocks of foam 63*a, b, c* and *d* to add buoyancy to the sled 60 to offset the weight of the flowlines 31 and 32 and of the sled itself and to facilitate the dragging of the sled 60 across the sea floor. The sled 60 is also provided with a pair of hydraulically-controlled valves 66 and 67 control the passage of fluid through the internal conduits 64 and 65 and thus of fluid into the flowlines 31 and 32. Each of the valves 66 and 67 is provided with a mechanical override 68 and 69 to allow manual control thereof.

The valves 66 and 67 are actuated through a series of hydraulic control lines 33. Fluid is passed from these lines 33 into the hydraulic control fluid mandrels or "stabs" 70 which engage the control system of a Christmas tree landed on the lower frame portion 37. Each of these mandrels 70 has a spring biased sheath 70′ to seal the entrance to the mandrel 70 until connection to the Christmas tree is made. The series of hydraulic lines 33 accompany the flowlines 31 andd 32 from the source thereof, which may be a onshore production system, for example. Two of these lines 33 act as hydraulic supply and return lines. As mentioned, the other line carries hydraulic control fluid supplied from the onshore production system into the Christmas tree control system through the control fluid mandrels 70.

The pull-in frame 40 is shown in more detail in FIGS. 4, 5 and 8. The pull-in frame 40 includes the upper frame 38 and the lower frame 37. Depending downwardly from the lower frame 37 are a plurality of guide legs 48*a, b,* and *c,* along with a fourth leg which has not been shown. Each of the legs 48 are provided with a flange 48′. The legs 48 support the pull-in frame 40 when disposed on the sled 60, as shown in FIG. 3.

The lower frame 37 is also provided with a downwardly depending hollow mandrel 49, as shown in FIG. 5. The mandrel 49 is provided with a frustoconical end portion for engagement with a conical guide surface 26 in the wellhead 20. The hollow mandrel 49 allows the lower frame 37 to land on the wellhead 20 with the guide legs 48 in proper alignment with the guide holes 28 to lock the lower frame 37 to the guide base24. The hollow mandrel also allows the landing of a Christmas tree onto the lower frame 37 to establish fluid communication between the well and the flowlines 31 and 32.

The pulling of the sled 60 into engagement with the frame 40 is done by means of a pair of positive displacement hydraulically actuated winches 41, only one of which has been shown in the figures. The hydraulically activated winches are of a type known in the art. The pair of cables 50 and 51 each have an end attached to the tapered mandrels 71 extending from the sled base 58 and to one of the winches 41. The cables 50 and 51 pass through mandrel ports 52 and 53 in the lower frame 51, over a pair of pulleys 47, only one of which has been shown in the drawings, to the winches 41. The tapered mandrels 71 are pulled completely into the mandrel ports 52 and 53, when the winches 41 reel in the cables 50 and 51, to bring the base 58 into engagement with the lower frame 37.

Figure 7:
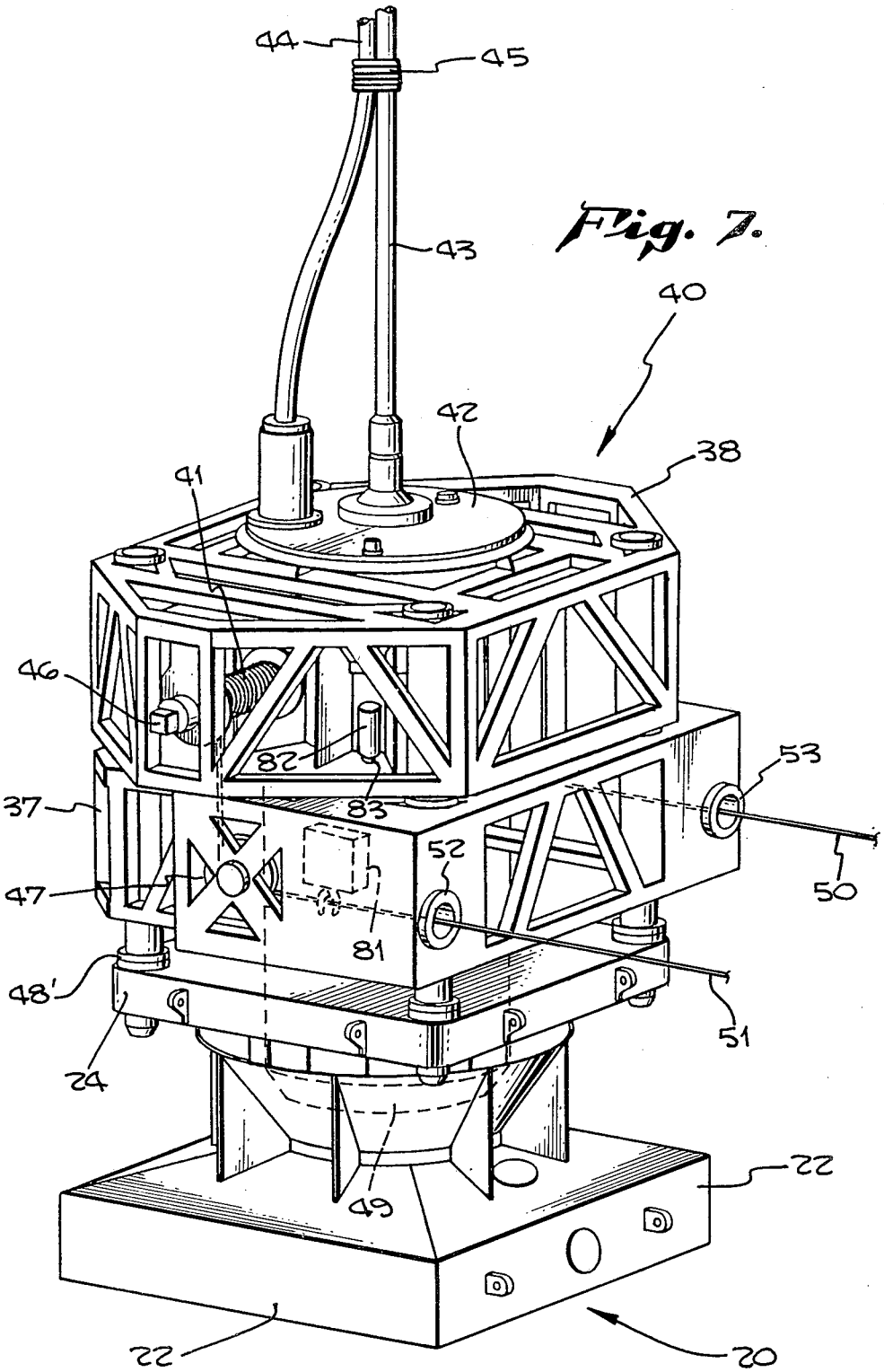
FIG. 7 shows a perspective view of the frame portion of the apparatus landed upon the wellhead, prior to reeling in the base portion into engagement thereto as shown in FIG. 1.

The winches 41 are attached to internal hydraulic lines, not separately shown, in the upper frame 38. These hydraulic control lines connect to the completion/workover connector 42, which is fastened to the upper frame 38. The workover connector 42 is attached to a drill pipe 43 from the floating vessel 18. As shown in FIG. 7, the drill pipe 43 has attached thereto by bands 45 or the like a hydraulic control hose 44 by which hydraulic fluid is passed to the winches 41. Each of the winches 41 is additionally provided with a manual override 46 in case the hydraulic connection to the overhead vessel is interrupted.

As shown in FIG. 7, the lower frame 37 is provided with a pair of hydraulically activated cable cutters 81 (Only one of which has been shown) as known in the art. The cutters 81 are also connected to the internal hydraulic control lines and are oriented so that the cables 50 and 51 pass through the cutter blades. The cutters 81 are activated from the vessel 18 after the base 58 has been drawn into engagement with the lower frame 37 to allow the disconnecting of the lower frame 37 from the upper frame 38.

As also shown in FIGS. 7 and 9, the lower and upper frames 37 and 38 are attached by hydraulically releasable pins 83 in the lower frame 37 engaging sockets 82 in the upper frame 38. The sockets 82 are connected to the internal hydraulic control lines to allow the vessel 18 to release the pins 83 from the sockets 82, after the cables 50 and 51 have been cut, to allow the vessel 18 to lift the upper frame 38 off the lower frame 37, as shown in FIG. 9. Alignment between the upper frame 38 and the lower frame 37 prior to separation is maintained by four guide legs 85 (only three of which 85*a, b, c* have been shown) in the upper frame 38 which engage corresponding recesses 86 (only two of which 86*a* and 86*d* have been shown) in the lower frame 37.

As seen from the foregoing, the present invention not only provides a novel apparatus, but also provides a novel method for connecting the flowlines 31 and 32 to the wellhead 20. To briefly summarize the method, the sled 60 and the two-part frame 40, which comprise a remote vehicle, are positioned on the sea floor attached to the flowlines 31 and 32, as shown in FIG. 1. The remote vehicle may be as much as 300 feet from the wellhead 20. Thereafter, the riser 14 is connected from the vessel 18 to the frame 40 and the frame 40 is lifted off the sled 60 and positioned over the wellhead 20, as shown in FIG. 4. The frame 40 is then landed onto the wellhead, with the mandrel 49 engaging the conical guide 26 in the wellhead housing 25. As the frame 40 is lowered onto the wellhead, the guide legs 48 in the lower frame 37 engage the mounting holes 28 on the guide base 24, as shown in FIG. 5. The frame 40 is thereafter landed on the wellhead 22, as shown in FIG. 7, and hydraulic fluid is supplied from the vessel 18 into the hose 44 to control the winches 41 which reel in the cables 50 and 51 and drag the sled 60 with the attached flowlines 31 and 32 across the sea floor. The dragging continues until the sled 60 lifts off the sea floor and engages the frame 40, as shown in FIG. 8. When this engagment is made, the tapered mandrels 71 enter the mandrel ports 52 and 53 and the flowline mandrels 72 are positioned outwardly of the lower frame 37. The cables 50 and 51 are then cut by the cable cutters 81 and the upper frame is released from the lower frame 37 by the pin 83 and socket 82 arrangement and is lifted off the lower frame by the vessel 18. A Christmas tree is then landed on the lower frame 37 to establish fluid communication between the flowline mandrels 72 and the well. The valves 66 and 67 on the sled base 58 are activated by hydraulic fluid from the production system entering the control lines 33 to allow fluid to pass through the flowline mandrels 72 through the internal conduits 64 and 65 on the sled 60 and thus into the flowlines 31 and 32.

In the foregoing description of the present invention, a preferred embodiment of the invention has been disclosed. It is to be understood that other mechanical and design variations are within the scope of the present invention. Accordingly, the invention is not limited to the particular arrangement which has been illustrated and described in detail herein.

What is claimed is:

1. A flowline pull-in apparatus operable from an overhead vessel for remotely transporting flowlines to a subsea wellhead, comprising:

flowline sled means, disposed on the sea floor, for supporting ends of said flowlines as said sled means is pulled across sea floor;

sled pulling means for pulling said sled means across said sea floor to said wellhead under control of said vessel; and cable means attached between said sled means and said sled pulling means, whereby said sled pulling means is placed upon said wellhead by said vessel and said cable means is collected on said sled pulling means to draw said sled means across said sea floor to position said flowlines adjacent said wellhead, a wellhead production system thereafter being landed on said sled pulling means to establish fluid communication between said wellhead and said flowlines;

said sled means comprising:

a sled base connected to said flowlines;

sled conduit means connected to said flowlines;

valve means disposed in said conduit means for controlling fluid flow through said flowlines;

flowline mandrel means, projecting from said base and connected to said valve means, for establishing fluid communication between said wellhead and said valve means;

and guide mandrel means, projecting from said base, for guiding said base into engagement with said sled pulling means when said sled means is drawn to said sled pulling means;

said sled pulling means comprising:

a two-part frame removably disposed within said sled base, said frame including an upper frame part and a lower frame part;

hydraulic latch means, operable from said vessel, for disconnecting said upper frame part from said lower frame part;

means for connecting said frame to a pipe string run from said vessel, thereby allowing said vessel to lift said frame from said sled base and place said frame upon said wellhead;

guide mandrel means, projecting downwardly from said lower frame part, for guiding said frame into position on said wellhead;

winch means, attached to said cable means and disposed within said upper frame part, for drawing said cable means into said sled pulling means; and cable cutting means, whereby after said frame is placed on said wellhead by said vessel, said winch means is activated to reel said cable means into said upper frame part to position said flowlines adjacent said wellhead, said cable means being thereafter severed by said cutting means and said hydraulic latch means being thereafter released to allow said vessel to lift said upper frame part from said lower frame part and land a wellhead production system on said lower frame part to establish fluid communication between said wellhead and said flowlines.

2. A flowline pull-in apparatus, operable from an overhead vessel, for remotely transporting flowlines to a subsea wellhead attached to a subsea well and having a guide base, said apparatus comprising:

(a) flowline sled means, positioned on the sea floor for dragging thereacross, for supporting said flowlines, said sled means including:

a sled base having tapered edges to facilitate said dragging;

base conduit means, attached to said flowline sled means and including a plurality of flowline mandrels projecting from said base, for carrying fluid flow through said base to said flowlines;

valve means, disposed in said base conduit means, for controlling fluid flow into said flowlines, said valve means including a plurality of hydraulic control mandrels projecting from said base;

flotation control means, including a plurality of foam blocks, for controlling the buoyancy of said sled means;

guide mandrel means extending from said base;

wire rope means attached to said guide mandrel means;

(b) pull-in frame means for dragging said sled means across said sea floor to bring said flowlines into fluid communication with said well, said frame means including:

a frame having an upper frame part attached to said vessel and a lower frame part;

latch means for connecting said upper and lower frame parts together;

tubular mandrel means, depending downwardly from said lower frame part, for guiding said frame means into alignment with said wellhead;

winch means, disposed in said upper frame part and attached to said wire rope means, for reeling in said wire rope means; and cable cutting means, disposed in said lower frame, for severing said wire rope means, whereby said sled means and said frame means are first positioned as a unit on said sea floor, said vessel thereafter lifting said frame means from said sled means by said riser and landing said frame means on said wellhead, said removal of said frame means from said sled means extending said wire rope means, said vessel thereafter activating said winch means to reel said wire rope means into said upper frame part and drag said sled means across said sea floor until said guide mandrel means enters said upper frame part, whereupon said flowline mandrels and said hydraulic control mandrels are adjacent said wellhead, said cable cutting means thereafter being activated to cut said weir rope means and said latch thereafter being released, whereupon said vessel removes said upper frame part and lands a wellhead production system on said lower frame part to establish fluid communication between said well and said flowline mandrel means.

3. An apparatus as defined in claim 2, wherein said valve means and said winches each include manual override means for allowing manual actuation thereof.

4. A method of establishing fluid communication between a subsea wellhead and flowlines disposed remotely from said wellhead, comprising:

attaching said flowlines to a subsea sled carrying a body attached to said sled;

removing said body from said sled with a overhead vessel;

landing said body on said wellhead;

drawing said sled toward said body until said flowlines are adjacent said wellhead; and landing a wellhead production system on said body to establish fluid communication between said wellhead and said flowlines.

5. A method, controlled by an overhead vessel, for remotely carrying flowlines to a subsea wellhead and establishing communication therewith, comprising:

placing on the sea floor a sled attached to said flowlines and carrying a frame connected to said vessel and attached by cables to said sled, said frame having an upper frame part and a lower frame part;

lifting said frame by said overhead vessel from said sled and landing on said wellhead;

activating winches on said frame to reel in said cables to drag said sled with said attached flowlines across the sea floor and into engagement with said lower frame part;

severing said cables;

removing said upper frame part from said lower frame part; and landing a wellhead production system on said lower frame part to establish fluid communication between said wellhead and said flowlines.

6. A flowline pull-in apparatus operable from an overhead vessel for remotely transporting flowlines to a subsea wellhead, comprising in combination:

flowline sled means, disposed on the sea floor, for supporting ends of said flowlines as said sled means is pulled across said sea floor, said flowline sled means having a seat;

a frame adapted to fit within the seat of said flowline sled means;

means for connecting said frame to a pipe string run from said vessel to allow said vessel to lift said frame away from the seat of said sled means and land said frame upon said wellhead;

winch means, including a driven drum, disposed on said frame and connected to said sled means by a cable, for playing out said cable as said frame is moved from said flow line sled means to said wellhead and for pulling said sled means across said sea floor to said wellhead after said frame has landed on said wellhead, by winding said cable about said drum.

7. A flowline pull-in apparatus operable from an overhead vessel for remotely transporting flow lines to a subsea wellhead, comprising in combination:

flowline sled means, disposed on the sea floor, for supporting ends of said flowlines as said sled means is pulled across said sea floor, said flowline sled means having a seat;

a two-part frame adapted to fit within the seat of said flowline sled means and having an upper frame part and a lower frame part;

means for connecting said frame to a pipe string run from said vessel to allow said vessel to lift said frame away from the seat of said sled means and land said frame upon said wellhead;

guide means on said lower frame part for guiding said frame into position on said wellhead;

winch means disposed on said upper frame and connected to said sled means by a cable, for playing out said cable as said frame is moved from said flowline sled means to said wellhead and for pulling said sled means across said sea floor to said wellhead with said cable after said frame has landed on said wellhead; and latch means for disconnecting said upper frame part from said lower frame part for removal of said upper frame part and winch means from said wellhead after said sled means is positioned at said wellhead.

* * * * *